US009273903B2

(12) United States Patent
Vian et al.

(10) Patent No.: US 9,273,903 B2
(45) Date of Patent: Mar. 1, 2016

(54) LAUNDRY DRYER

(75) Inventors: Alessandro Vian, Meduna di Livenza (IT); Marco Santarossa, S. Quirino (IT); Sergio Pillot, Pasiano di Pordenone (IT)

(73) Assignee: Electrolux Home Products Corporation N.V., Brussels (BE)

( * ) Notice: Subject to any disclaimer, the term of this patent is extended or adjusted under 35 U.S.C. 154(b) by 234 days.

(21) Appl. No.: 13/989,548

(22) PCT Filed: Nov. 24, 2011

(86) PCT No.: PCT/EP2011/070899

§ 371 (c)(1),
(2), (4) Date: Dec. 3, 2013

(87) PCT Pub. No.: WO2012/072477

PCT Pub. Date: Jun. 7, 2012

(65) Prior Publication Data

US 2014/0144035 A1 May 29, 2014

(30) Foreign Application Priority Data

Nov. 29, 2010 (EP) ..... 10192902

(51) Int. Cl.
*D06F 58/20* (2006.01)
*F26B 21/08* (2006.01)
(Continued)

(52) U.S. Cl.
CPC ..... *F26B 21/08* (2013.01); *D06F 58/24* (2013.01); *D06F 58/20* (2013.01); *D06F 58/206* (2013.01); *D06F 58/22* (2013.01)

(58) Field of Classification Search
CPC ..... F26B 49/00; F26B 21/00; F26B 21/06; D06F 58/00; D06F 58/12; D06F 58/20
USPC ..... 34/595, 601, 610; 68/12.06, 19, 20
See application file for complete search history.

(56) References Cited

U.S. PATENT DOCUMENTS 6,868,689 B1 3/2005 McNeil et al.
7,055,262 B2 * 6/2006 Goldberg et al. ..... 34/86
(Continued)

FOREIGN PATENT DOCUMENTS

DE 100 02 742 6/2001
DE 20304521 U1 5/2003
(Continued)

OTHER PUBLICATIONS

International Search Report mailed May 18, 2012 in corresponding International Application No. PCT/EP2011/070899.
(Continued)

*Primary Examiner* — Stephen M Gravini
(74) *Attorney, Agent, or Firm* — Banner & Witcoff, LTD.

(57) ABSTRACT

A laundry dryer has a casing (1) accommodating therein a drying air circuit and operational devices for carrying out a drying treatment on laundry. The dryer further includes a basement (8, 108) having a condensate draining path (21, 121) for conveying moisture condensed from drying air towards a reservoir (24, 124). At least one condensate retaining region (29A, 29B; 129A, 129B) is provided in the condensate draining path (21, 121) and/or on reservoir (24, 124) thereby forming a liquid trap for preventing drying air dispersing along path (21, 121) from entering reservoir (24, 124).

20 Claims, 13 Drawing Sheets

(51) Int. Cl.
*D06F 58/24* (2006.01)
*D06F 58/22* (2006.01)

(56) References Cited

U.S. PATENT DOCUMENTS

| | | | | |
|---|---|---|---|---|
| 7,921,578 | B2 * | 4/2011 | McAllister et al. | 34/597 |
| 8,082,678 | B2 * | 12/2011 | Paruzzolo et al. | 34/73 |
| 8,572,862 | B2 * | 11/2013 | TeGrotenhuis | 34/82 |
| 8,844,163 | B2 * | 9/2014 | Palazzin et al. | 34/603 |
| 8,973,286 | B1 * | 3/2015 | Hyde et al. | 34/595 |
| 9,045,854 | B2 * | 6/2015 | Clark | 1/1 |
| 2006/0272173 | A1 | 12/2006 | Myung | |
| 2014/0144035 | A1 * | 5/2014 | Vian et al. | 34/73 |
| 2014/0144038 | A1 * | 5/2014 | Santarossa et al. | 34/108 |
| 2014/0165416 | A1 * | 6/2014 | Pillot et al. | 34/82 |

FOREIGN PATENT DOCUMENTS

| | | | | |
|---|---|---|---|---|
| EP | 0 211 418 | | 2/1987 | |
| EP | 1550764 | A1 | 7/2005 | |
| EP | 1887127 | A1 * | 2/2008 | D06F 58/20 |
| EP | 2103732 | A1 * | 9/2009 | D06F 58/06 |
| EP | 2128328 | A1 * | 12/2009 | D06F 58/24 |
| EP | 2261416 | A1 * | 12/2010 | D06F 58/20 |

OTHER PUBLICATIONS

European Search Report dated Jun. 22, 2011 in corresponding EP Application No. 10192902.4.

International Search Report mailed May 5, 2012 in related International Application No. PCT/EP2011/070935.

Extended European Search Report mailed Jun. 21, 2011 in related European Application No. 10192931.3.

European Office Action mailed Feb. 2, 2013 in related European Application No. 10192931.3.

International Search Report mailed May 30, 2012 in related International Application No. PCT/EP2011/070920.

* cited by examiner 24
8
31
29A
41
28
26
28
14
27
21
13
28
28
28
26
21
27
40
35
36
35
15
21
30B
29B

LAUNDRY DRYER

BACKGROUND

Laundry dryers generally comprise a casing that houses a laundry container, like a rotating drum, where laundry to be treated is received, and an air circuit for carrying out drying operation by circulating hot air through the laundry container. In a heat pump laundry dryer, drying air coming out from the laundry container is first dehumidified through a first heat exchanging portion (a refrigerant fluid evaporating unit) of a heat pump circuit, and then heated through a second heat exchanging portion (a refrigerant fluid condensing unit) of the same heat pump circuit thereby achieving a considerable energy saving compared to a condenser type laundry dryer. In the latter type of laundry dryer, condensing means in the form of an air-air heat exchanger are provided in the drying air circuit for removing moisture from laundry drying air while heat is generated by an electric resistance placed within the drying air circuit.

Both in heat pump and in condenser dryers moisture removed from drying air is collected within a reservoir located in the cabinet bottom part and then pumped up to a removable container placed on a front upper portion of the cabinet by pumping means. Since condensed moisture is drained from the drying air circuit, in prior art dryers part of such air may be drained together with moisture and being sucked into said pumping means thereby causing damages and/or a malfunction of the draining system.

In addition, even when filtered, drying air may comprise fluff particles that can cause pump clogging in case an amount of drying air mixes with condensed moisture. Fluff accumulated on those parts of the drying air circuit just downstream of the main air filter, which is generally provided in proximity of an air outlet port in the laundry container, may be flushed away by moisture contained in drying air when the latter passes through cold surfaces. This problem may arise especially after a relatively large number of cycles or when drying air filters and/or condensing devices are not periodically cleaned.

Furthermore, prior art laundry dryers generally provides draining arrangements in correspondence of elements, such as an evaporator in a heat pump type dryer or a condenser in a condenser type dryer, where moisture is effectively condensed but such dryers have no provision for collecting condensate in other regions of the drying air circuit where temperature may be favorable to moisture condensation. In a laundry dryer of heat pump type, one of the above said regions has been found to be the heat exchanger (a refrigerant fluid condensing unit) provided for heating the drying air flow. This is due to the fact that, in a heat pump type dryer, the position of the condensing unit is quite near to that of the cold surfaces of the evaporating unit and therefore moisture can be further condensed on a region of the condensing unit adjacent to the evaporating unit. Presence of condensate on a heat pump circuit condenser is particularly undesired because the condensing unit yield drops dramatically.

In a heat pump type dryer, a further potential moisture condensing surface may be the region in front of the evaporating unit, i.e. a region upstream of such unit considering the flow direction of laundry drying air, because the drying air enters that region with the highest amount of humidity with respect to the whole drying air circuit. Since that region may feel the evaporator low temperature, a moisture condensation becomes highly probable. In addition, in said region facing the evaporator unit, drying air flow changes its direction from a substantially vertical plane to a substantially horizontal plane. This causes air to contact drying air conduit walls thereby increasing possibility for a moisture condensation on such walls. A moisture condensation in that region may disadvantageously cause undesired and uncontrolled water shedding.

SUMMARY OF SELECTED INVENTIVE ASPECTS

The aim of the present invention is therefore to solve the noted drawbacks and thus provide a laundry dryer having an improved condensed water draining circuit.

An object of the present invention is to provide a laundry dryer preventing drying air from reaching a condensed water reservoir thereby avoiding possible water pump damages.

Another object of the present invention is to provide a laundry dryer having an improved performance in draining moisture condensed from a drying air flow.

A further object of the invention is to provide a laundry dryer having an improved reliability compared to prior art dryers.

Another object of the invention is to provide a laundry dryer avoiding the risk that moisture, which incidentally condenses on regions of a drying air circuit where temperature is favourable to such condensation, can decrease performance of operational components.

Yet another object of the present invention is to provide a laundry dryer wherein maintenance intervention operated by specialized technicians are simplified compared to known dryers.

Advantages, objects, and features of the invention will be set forth in part in the description and drawings which follow and in part will become apparent to those having ordinary skill in the art upon examination of the following or may be learned from practice of the invention. The objects and advantages of the invention may be reached and attained by a laundry dryer comprising a casing accommodating therein a drying air circuit and operational devices for carrying out a drying treatment on laundry, said dryer further comprising a basement having a condensate draining path for conveying moisture condensed from drying air towards a reservoir wherein at least one condensate retaining region is provided in the condensate draining path and/or on the reservoir thereby forming a liquid trap for preventing drying air dispersing along the path from entering the reservoir. Preferably, at least one condensate retaining region comprises a siphon-shaped surface. Preferably, the condensate draining path extends at least partly on an edge region of the basement from a front to a rear side thereof. Preferably, the condensate draining path is in fluid communication with one or more supporting surfaces provided on the basement for supporting one of said operational devices. Preferably, the one or more supporting surfaces comprise at least a condensate guide for guiding condensate towards the draining path. Preferably, the condensate draining path extends, at least in part, transversally relative to said condensate guide. Preferably, the condensate draining path, and/or the at least one condensate retaining region and/or the reservoir are integrally formed with the basement. Preferably, the reservoir is arranged in proximity of a first cabinet rear wall, which is opposite to a second cabinet front wall on which a laundry loading opening is formed, so as to be accessible from the outside rear part of machine casing. Preferably, the condensate draining path extends at least partly within the drying air circuit, and the reservoir is separated from the circuit. Preferably, at least one condensate retaining region comprises a filter. Preferably, the operational devices comprises a heat pump system having a refrigerant fluid evaporating unit resting onto a supporting surface formed in the basement, a condensate retaining region being arranged onto a surface that extends upstream of said supporting surface. Preferably, the condensate draining path extends from a surface provided in a region of basement upstream of said refrigerant fluid evaporating unit supporting surface towards the reservoir. Preferably, the basement comprises an air pumping device supporting seat having a through bore in fluid communication with the reservoir by means of a hose. Preferably, the hose comprises a condensate retaining region formed by bending the hose in a U-shaped configuration. Preferably, the hose and the condensate draining path are arranged on opposite sides of the basement.

BRIEF DESCRIPTION OF THE DRAWINGS

The accompanying drawings, which are included to provide a further understanding of the invention and are incorporated in and constitute a part of this specification, illustrate possible embodiments of the invention and together with the description serve to explain the principles of the invention. Like reference numbers represents like features throughout the accompanying drawings, wherein.

DETAILED DESCRIPTION OF EXAMPLE EMBODIMENTS

Figure 1:
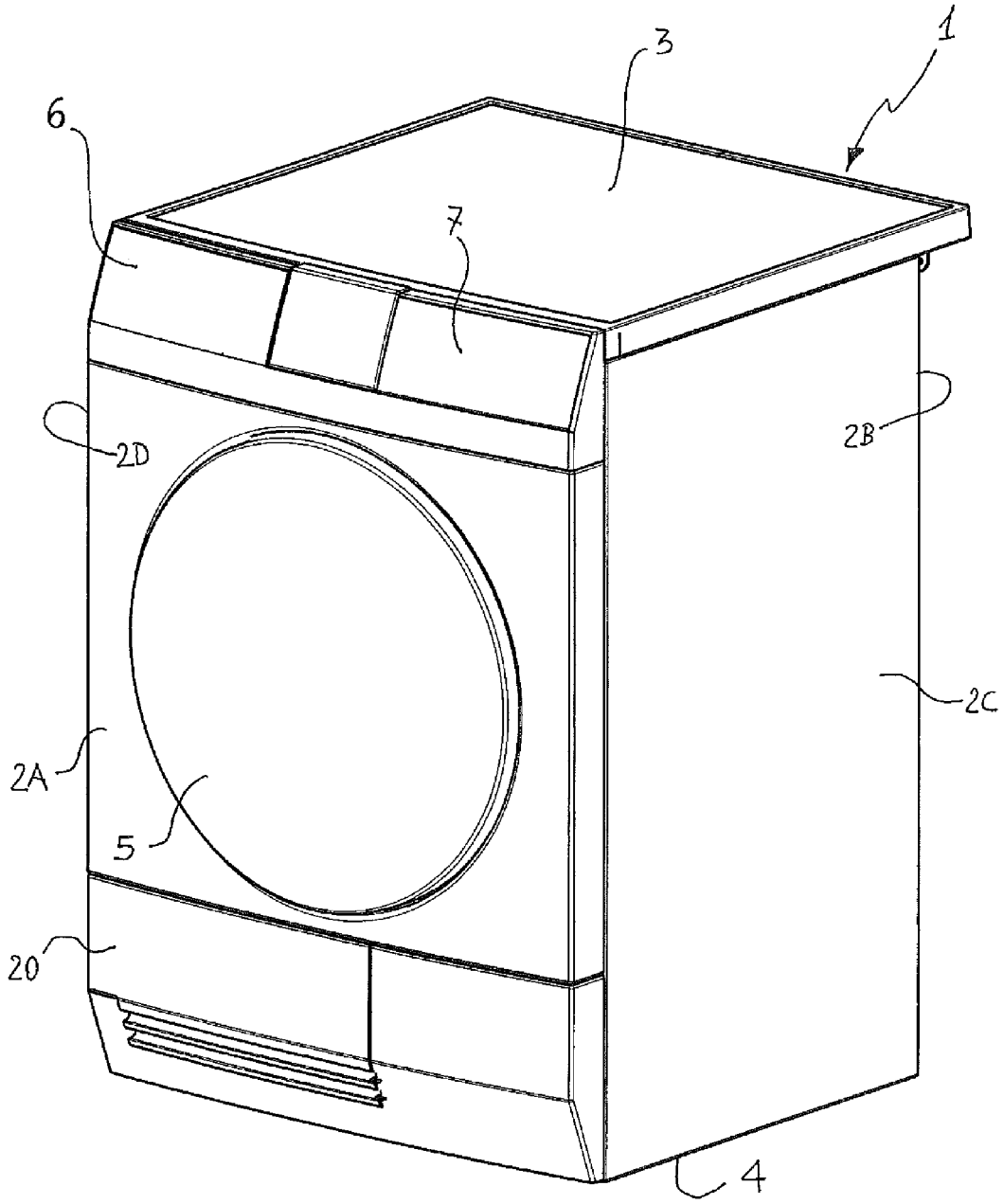
FIG. 1 shows a perspective view of a laundry dryer according to the invention.

With reference to FIG. 1, a laundry dryer according to the invention comprises a casing 1 formed by a first couple of upright side walls 2A, 2B arranged on a front and rear side of the treating machine and by a second couple of upright side wall 2C, 2D arranged on lateral sides of such machine. An upper wall portion 3 and a bottom wall portion 4 close the ends of the box-like structure formed by the upright side walls 2A, 2B, 2C, 2D, joined together.

A laundry container comprising a drum (not shown) rotatably mounted within the casing 1. Further operational devices, such as heat exchanging devices, fluid conduits, fluid pumping devices and so on, for carrying out a drying treatment on laundry are provided within the casing 1. A front door 5, pivotally coupled to the front upright side wall 2A, is provided for closing a laundry loading opening allowing access to the drum interior region to place laundry to be treated therein.

An extractable moisture tank in the form of a drawer 6 is slidably arranged on the top of the casing 1, for being periodically emptied by a user in case the laundry dryer cannot be connected to a waste water net through a pipe. A user control interface 7 is arranged on the top of the casing 1 near the drawer 6 for input of laundry drying programs and displaying machine working conditions.

Figure 2:
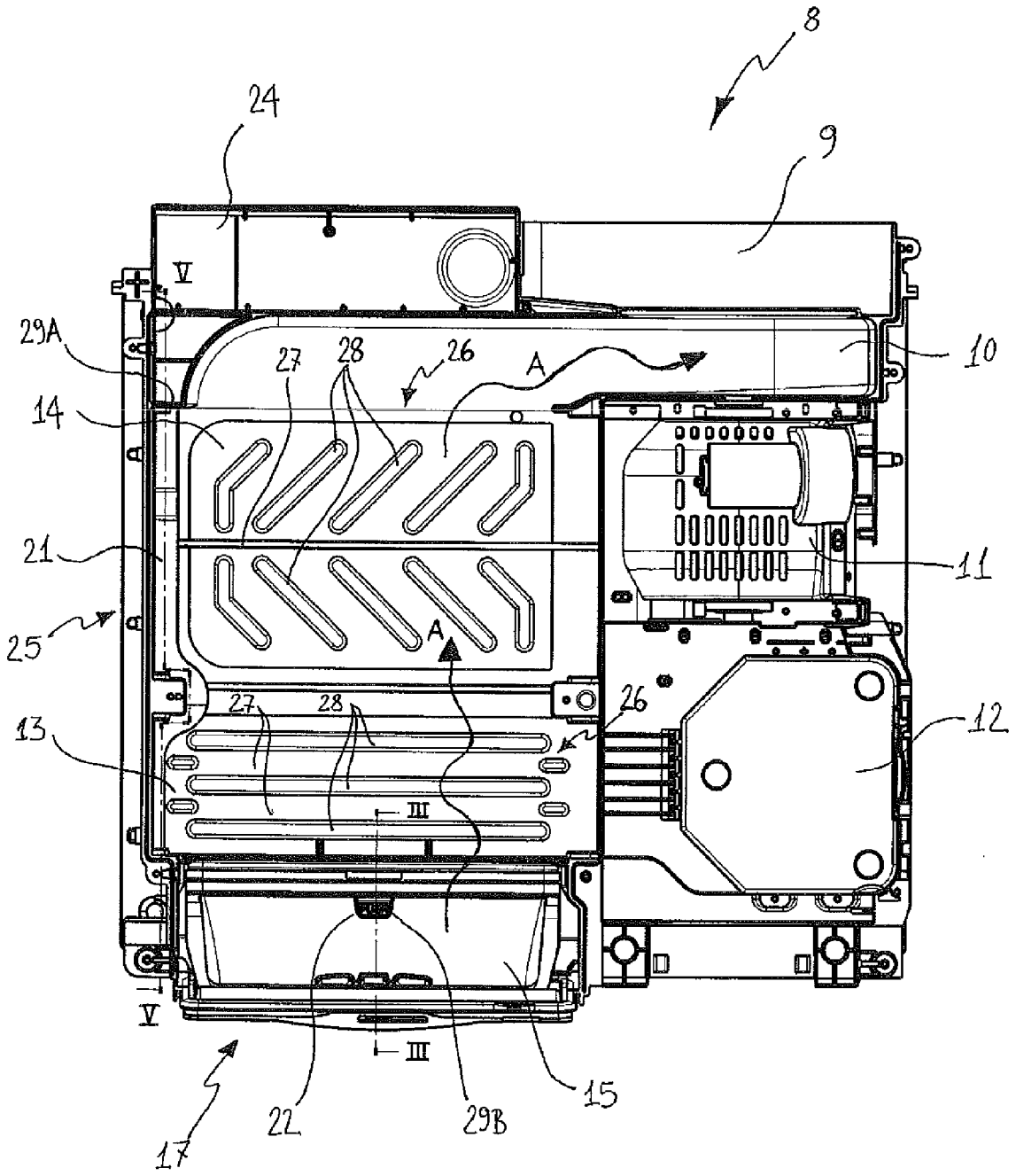
FIG. 2 shows a plane view of a first embodiment of a basement for a laundry dryer according to the invention.

On a bottom inner portion of the casing 1 a basement 8, 108 is provided as supporting structure for operational devices of the drying machine. In FIG. 2 it is disclosed a first embodiment of a basement 8 suitable for being mounted on a heat pump type laundry drying machine. Basement 8 comprises a fan seat portion 9 for partly receiving a fan (not shown) that receives drying air, i.e. air circulating within a drying air circuit that fluidly connects a laundry container with air dehumidifying and air heating devices, from a conduit 10 collecting drying air after it is passed through said dehumidifying and heating devices. An electric motor seat 11 is arranged between the fan seat 9 and a refrigerant fluid compressor seat 12 such that an electric motor (not shown) may be accommodated on seat 11 and operatively connected to a fan and a refrigerant fluid compressor for powering them through a single shaft line.

A refrigerant fluid compressor (not shown) is received on its seat 12 and forms part of a heat pump system which is further provided with a refrigerant fluid evaporating unit and a refrigerant fluid condensing unit for respectively dehumidifying and heating drying air passing therethrough. Such evaporating unit and condensing unit may be accommodated on supporting surfaces 13, 14 formed onto basement 8. The refrigerant fluid condensing unit supporting surface 14 faces conduit 10 such that drying air heated by said condensing unit may be cyclically directed towards a fan inlet and then supplied to a laundry container.

Figure 3:
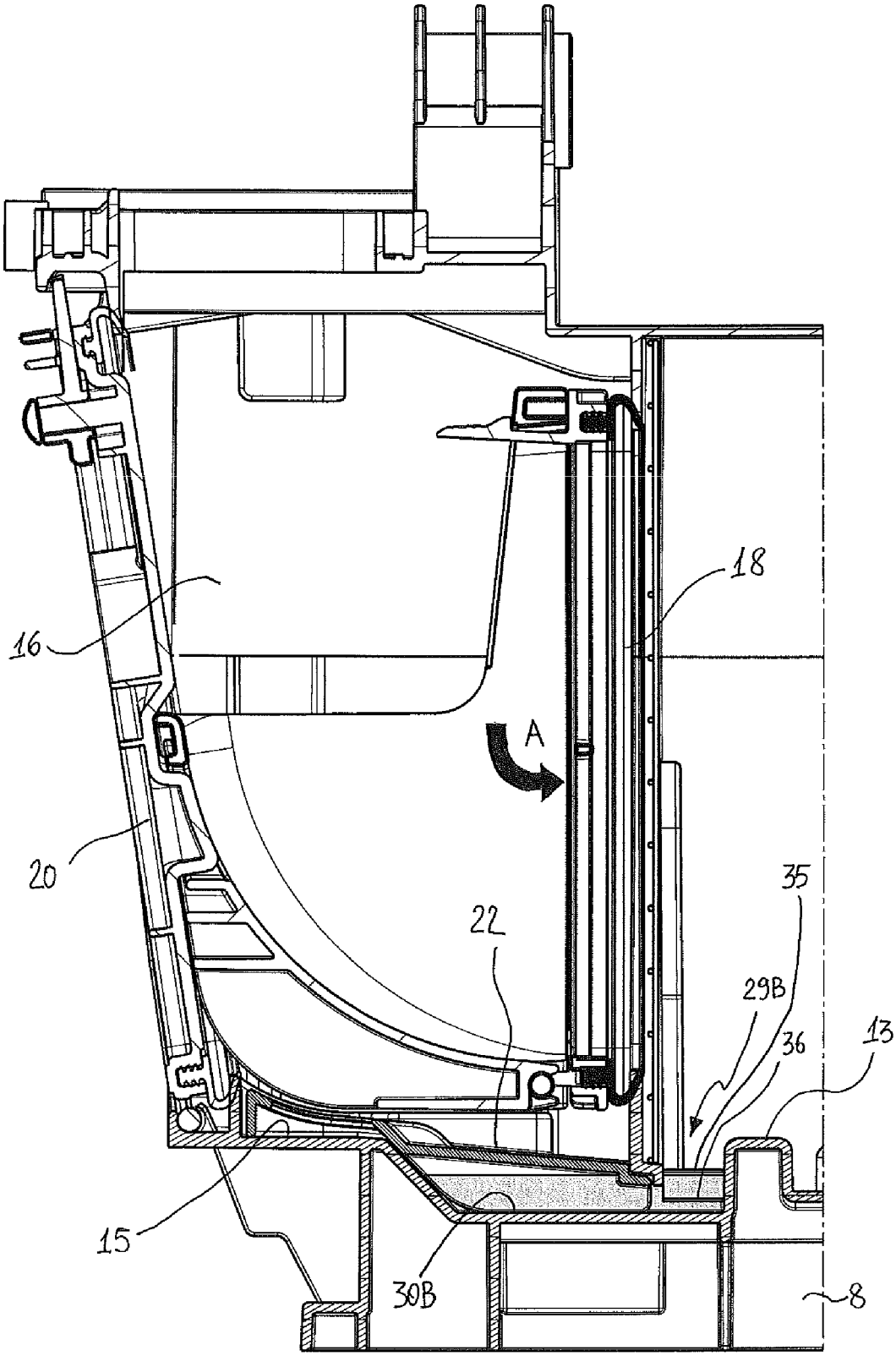
FIG. 3 shows a cross sectional view taken along line III-III in FIG. 2.

A surface 15 is provided in a basement region 17 upstream of said refrigerant fluid evaporating unit supporting surface 13 considering the drying air flow direction schematically indicated by arrows A in FIG. 2. Surface 15 is placed at the bottom of a chamber 16 (FIG. 3) and it is slightly sloping towards the refrigerant fluid evaporating unit. Chamber 16 receives drying air coming out from a laundry container lying over the basement 8 and then directs such air towards the refrigerant fluid evaporating unit for removing moisture therefrom by a condensing operation. Inside chamber 16 drying air changes its flow direction from a substantially vertical plane to a substantially horizontal plane before reaching the refrigerant fluid evaporating unit. Furthermore, within chamber 16, the basement region 17 is, preferably, provided with a fluff filter 18 extending in a transverse direction relative to the drying air flow schematically indicated by arrow A in FIG. 3. Periodical cleaning of fluff filter 18 may be performed manually by removing filter 18 after having accessed chamber 16 through an opening 32 (FIG. 4) covered by a hinged door 20.

Figure 4:
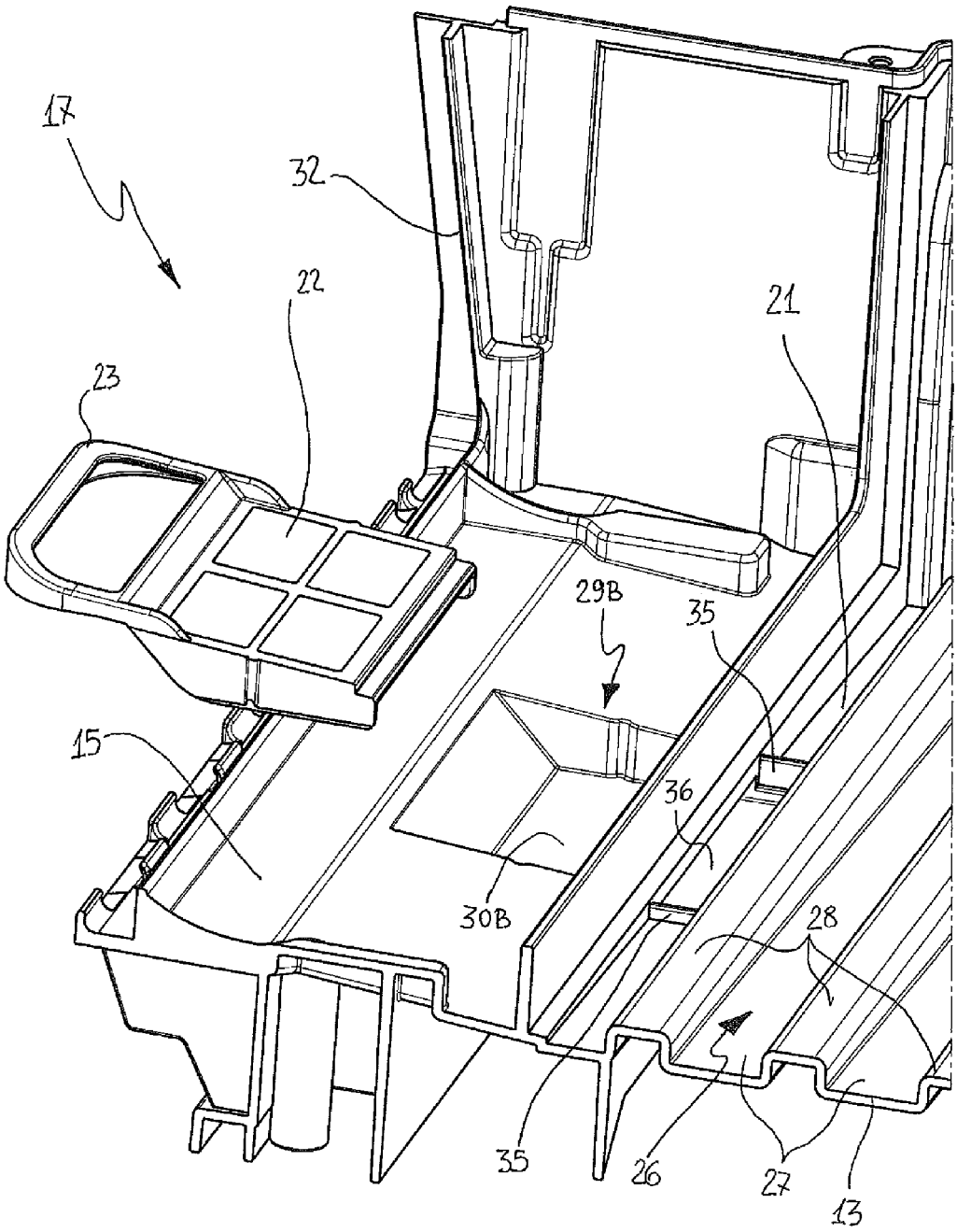
FIG. 4 shows a perspective view of a front part of the basement shown in FIG. 2 with a disassembled fluff filter.

Since surface 15 faces the evaporating unit of the heat pump system, i.e. a heat exchanger capable of condensing moisture contained in drying air, and considering that chamber 16 receives drying air after it has just left the laundry container, i.e. air highly enriched in moisture, surface 15 is arranged to drain moisture that condenses before entering the evaporating unit. A portion of a condensate draining path 21, 29B, 30B is therefore provided on surface 15 of basement region 17, i.e. in a front portion thereof. As mentioned above surface 15 is slightly sloping towards the refrigerant fluid evaporating unit, therefore condensate may flow towards path 21 sliding on surface 15 under gravity force effect. Walls 35 protrude from surface 13 to form a condensate collecting portion 36 that, when filled with condensate, generates a liquid trap preventing drying air entering chamber 16 to bypass filter 18 escaping underneath the latter. In this way drying air rich in fluff is not passed towards the evaporating unit without being filtered through filter 18. Since drying air within chamber 16 has not yet passed through fluff filter 18, moisture condensed in that basement region 17 may have a relatively large amount of fluff impurities dispersed therein. For this reason a filter 22 is, preferably, provided onto the surface 15. In this way, condensate is filtered by filter 22 before entering the draining path 21. In order to allow periodical cleaning of filter 22, the later is, preferably, associated to a removable support 23 mountable on surface 15 by arranging it on a region 29B formed on such surface 15 as shown in FIG. 4 and as it will be further described below.

Figure 6:
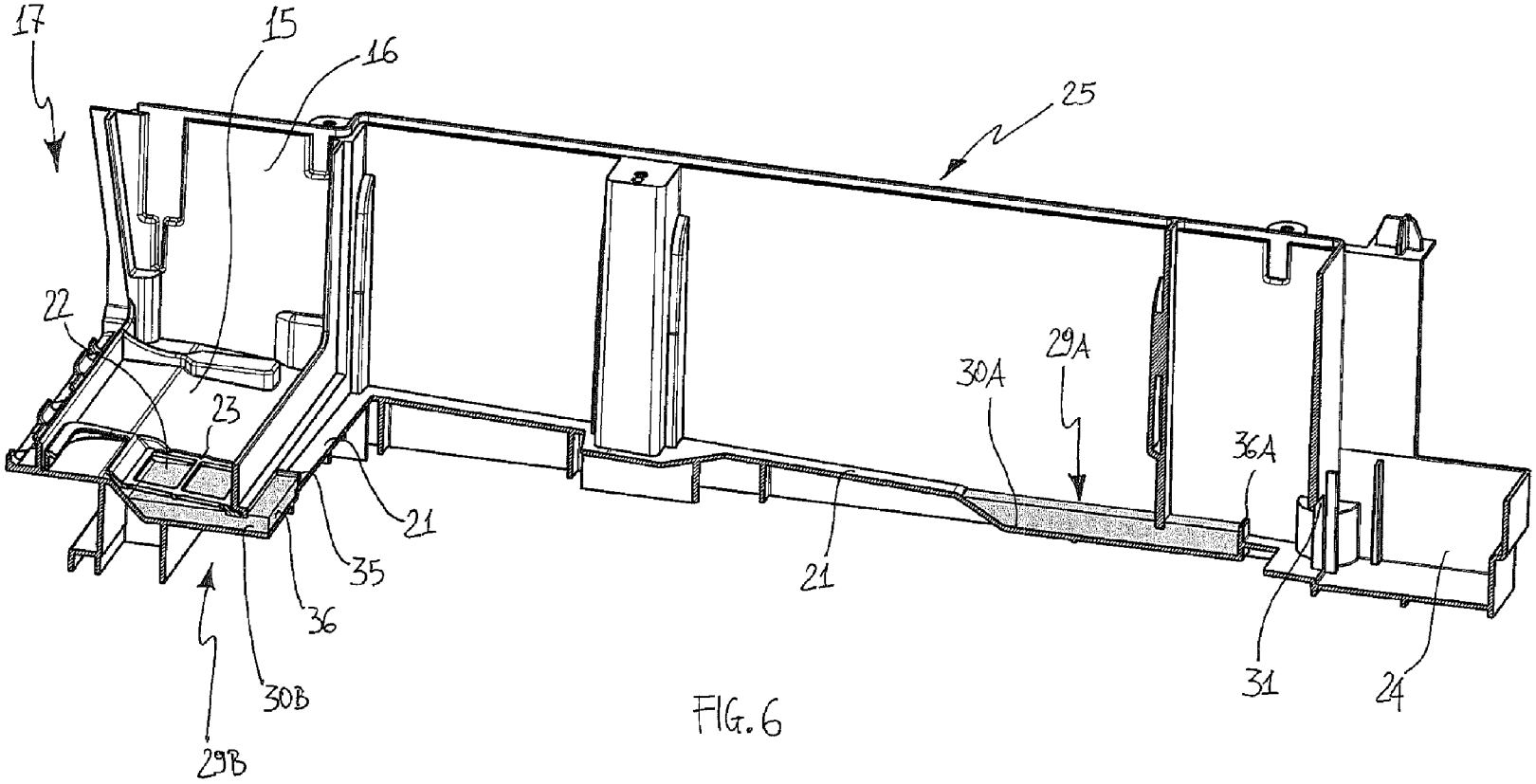
FIG. 6 shows a perspective cross sectional view taken along line V-V in FIG. 2.
Figure 7:
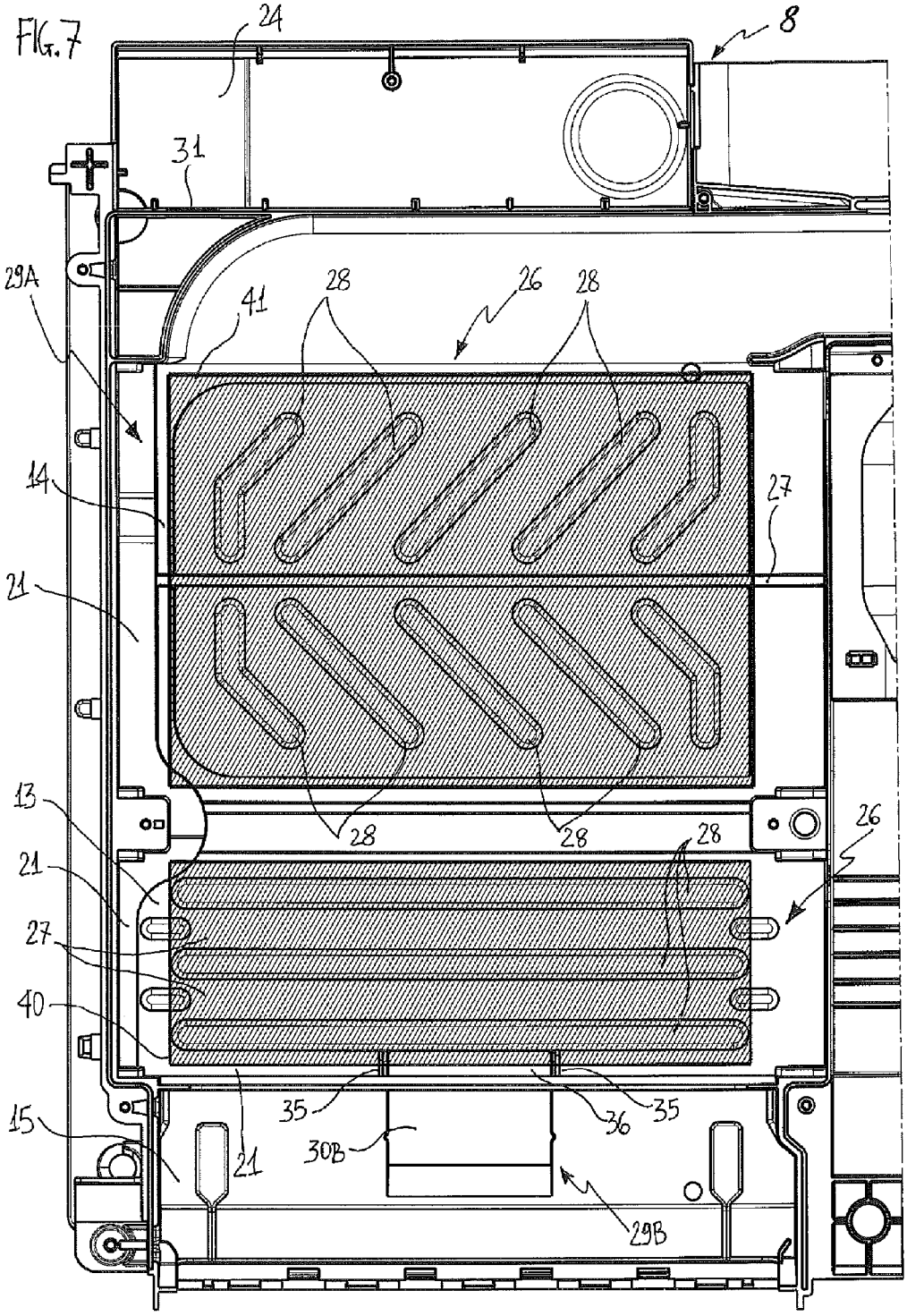
FIG. 7 shows an enlarged view of a part of FIG. 2 with evidenced areas for supporting a refrigerant fluid evaporating unit and a refrigerant fluid condensing unit.

As illustrated in FIG. 2, condensate draining path 21, that is preferably made integral with basement 8, extends from a front to a rear side of basement 8 along an edge region 25 thereof, and preferably in a direction which is substantially parallel to a drying air flow direction schematically indicated by arrows "A" in FIG. 2. In particular, condensate draining path 21 is configured and arranged not only to collect condensate dropped from the refrigerant fluid evaporating unit and that formed within chamber 16 as described above, but also condensate that may incidentally drop from the refrigerant fluid condensing unit. In order to remove said condensate and conveying it towards a reservoir 24 provided on basement 8, and preferably integrally molded thereon, condensate draining path 21 is in fluid communication with the evaporating unit supporting surface 13 and with the condensing unit supporting surface 14 thereby avoiding undesired condensate accumulation on operational devices of laundry machine. Preferably, as shown in FIGS. 2, 6 and 7, condensate draining path 21 runs onto a basement surface portion 25 that supports neither the refrigerant evaporating unit nor the refrigerant condensing unit whose resting areas 40, 41 have been indicated in FIG. 7 with a couple of rectangular hatches over supporting surfaces 13, 14, respectively. Over the condensate draining path 21 it may extend only pipes bent portions for circulating a refrigerant inside said evaporating and condensing units, however, such pipes bent portions lays on higher planes relative to path 21 surface and therefore they do not touch the latter that remains free from obstructions and let the condensate to be drained towards reservoir 24. In other words, condensing draining path 21 preferably surrounds supporting surfaces 13, 14 without passing through them.

In practice, condensate draining path 21 extends along a basement surface portion 25, which is free from evaporating and condensing units that therefore do not rest on that portion of the basement 8.

Each of said supporting surfaces 13 and 14 comprises at least one condensate guide 26 that extends transversally relative to condensate draining path 21 and has one or more walls 27, preferably sloping walls, integrally formed with basement 8 that extend transversally with respect to the extending direction of condensate draining path 21 and slope towards the latter such that condensate, under gravity force, flows to path 21. Further conveyors 28 configured and arranged for directing condensate towards sloping walls 27 are provided onto supporting surfaces 13 and 14, and such conveyors 28 may serve as resting surfaces for refrigerant fluid condensing and evaporating units.

Figure 5:
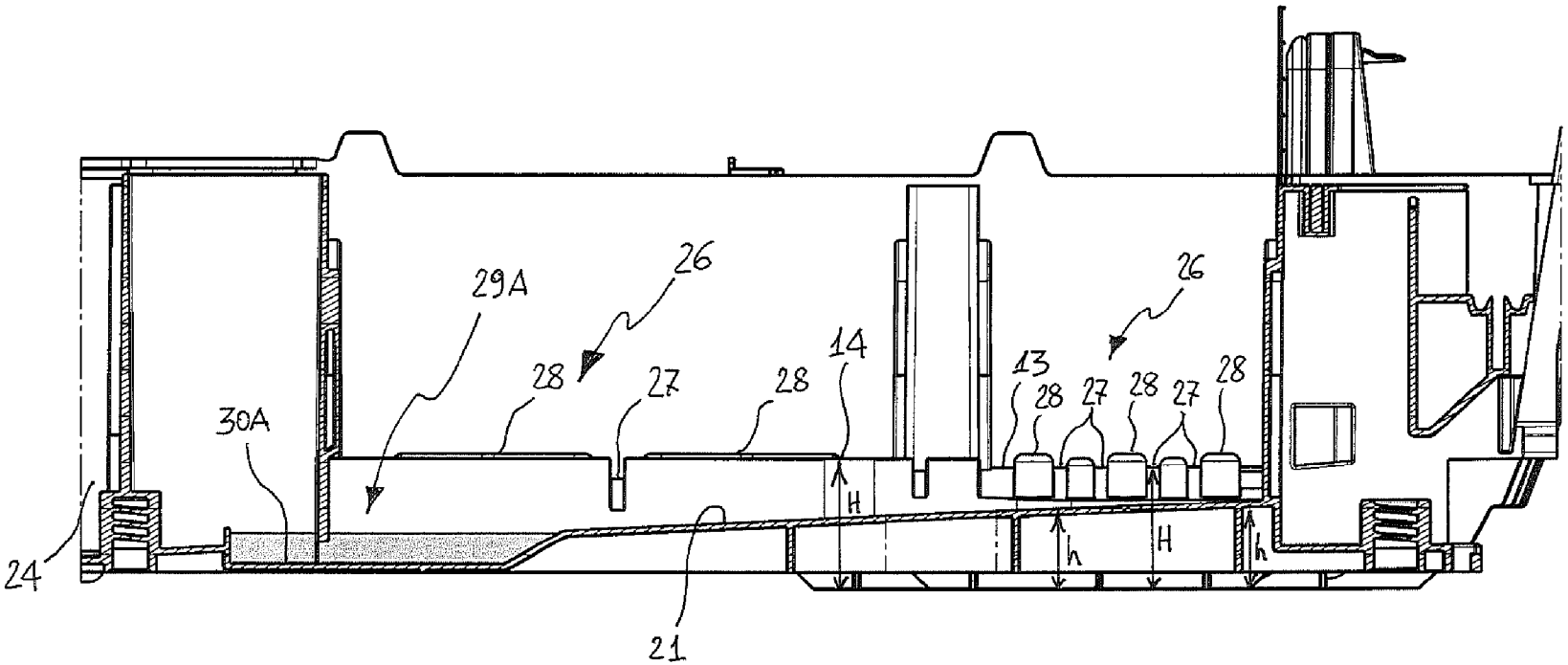
FIG. 5 shows a side cross sectional view taken along line V-V in FIG. 2.

FIG. 5 shows a side cross sectional view of basement 8 taken along line V-V in FIG. 2. As it can be seen, condensate draining path 21 slopes from the front part of basement (right side in FIG. 5) to the rear part thereof (left side in FIG. 5). In addition, supporting surfaces 13 and 14 are placed on a level "H" that is higher than levels "h" of condensate path 21 relative to the resting surface of basement 8 on a floor and form an angle with the path 21 extension surface. In other words, with a resting surface of basement 8 on a floor as reference, the basement surface portion 25 shown in FIGS. 2, 6 and 7 extends on a lower level compared to supporting surfaces 13, 14. In this way, under gravity force, condensate can first flow from supporting surfaces 13, 14 into path 21 and then towards a reservoir 24.

Figure 8:
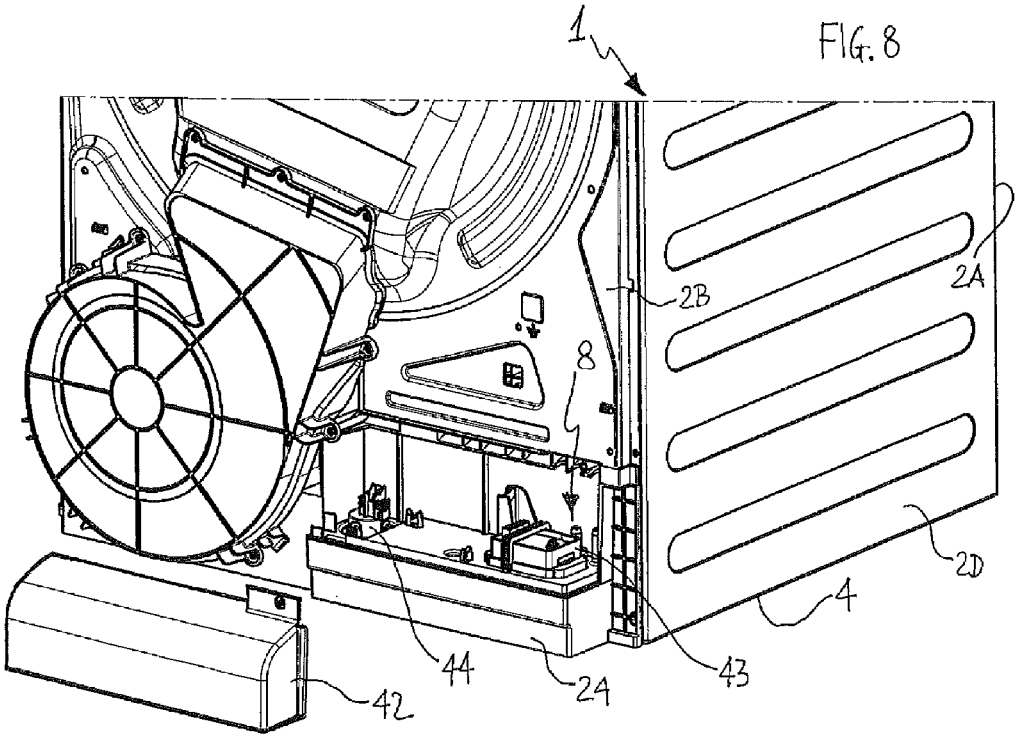
FIG. 8 shows a rear perspective view of a portion of the laundry dryer illustrated in FIG. 1.

As shown in FIG. 8, reservoir 24 is advantageously placed in the rear part of basement 8 in proximity of, but without being covered by, cabinet rear wall 2B, i.e. the wall opposite to cabinet wall 2A provided with a laundry loading opening closed by a hinged door 5. Furthermore, reservoir 24 is protected by a cover 42 associated to the cabinet rear wall 2B through a screw or the like. In this way, reservoir 24 may be easily accessible from the outside rear part of machine casing 1 by removing cover 42 and without the need to disassemble the whole rear side upright cabinet wall 2B. Further advantageously, reservoir 24 may be integrally molded with basement 8.

Condensate received within reservoir 24 is pumped up by a pumping device 43 to an extractable moisture tank in the form of a drawer 6 (FIG. 1) placed on a front upper portion of the cabinet 1 for periodical emptying operation. By accessing reservoir 24 it is possible to reach pumping device 43 and a level sensor 44 that measures level of condensate within reservoir 24 to switch pumping device on only when condensate reaches a predetermined level within reservoir 24, maintenance operations can therefore be simplified.

As disclosed in the attached Figures, condensate air path 21 extends at least partly within drying air circuit while reservoir 24 is placed outside such circuit, i.e. it is separated from drying circuit. Therefore, in order to prevent drying air drained together with condensate along path 21 from reaching and entering reservoir 24, one or more condensate retaining regions 29A, 29B are provided in the condensate draining path 21 and/or on reservoir 24. The aim of said retaining regions 29A, 29B is to create a liquid barrier or trap to air that may accidentally be drained, i.e. dispersed through path 21. This can be achieved, for example, by a siphon-shaped surface 30A that may have an outlet opening 36A placed either upstream of a passage 31 leading condensate from path 21 to reservoir 24 as depicted in FIG. 6, or forming itself the opening 31, i.e. coinciding with opening 31 such that said siphon-shaped surface 30A has an outlet section within reservoir 24. In an alternative embodiment the outlet opening 36A can be provided downstream of opening 31.

Since a high probability to drain drying air though condensate draining path 21 exists in the basement region 17 upstream of said refrigerant fluid evaporating unit supporting surface 13, it is preferred that a further condensate retaining region 29B (FIGS. 2-4 and 6) is provided onto surface 15 placed at the bottom of chamber 16. Such region 29B, advantageously in the form of a siphon-shaped surface 30B, may provide a seat for the condensate filter 22 and, preferably, may removably receive the support 23 of condensate filter 22.

Either of condensate retaining regions 29A, 29B may be integrally formed onto basement 8 as part of the condensate draining path 21.

A further way to provide a liquid trap to drying air may be that of keeping opening 31 under a water head. This may be achieved by increasing the minimum water level inside the reservoir 24 on which pumping device 43 is activated for pumping condensate up to the extractable moisture tank in the form of a drawer 6. A water level increase can be obtained, in principle, by moving pumping device 43 and the condensate level sensor 44 higher relative to the resting surface of basement 8 on a floor. The applicant has found that the positioning height of pumping device 43 and level sensor 44 must take into consideration geometrical height dimensions of basement 8, and in particular level "H" of supporting surfaces 13, 14 and height "h" (FIG. 5) of condensate draining path 21 that constitutes limits for said positioning, beyond which a water reflux from reservoir 24 towards and over surfaces 13, 14 would be produced, thereby causing an undesirable dramatic drop of condensing and/or evaporating units yield. The effective location of pumping device 43 and level sensor 44 is actually a compromise between the above geometrical limits and the need of forming a sufficient water head into reservoir 24 so as to generate a liquid trap for air dispersing along condensate draining path 21.

Figure 9:
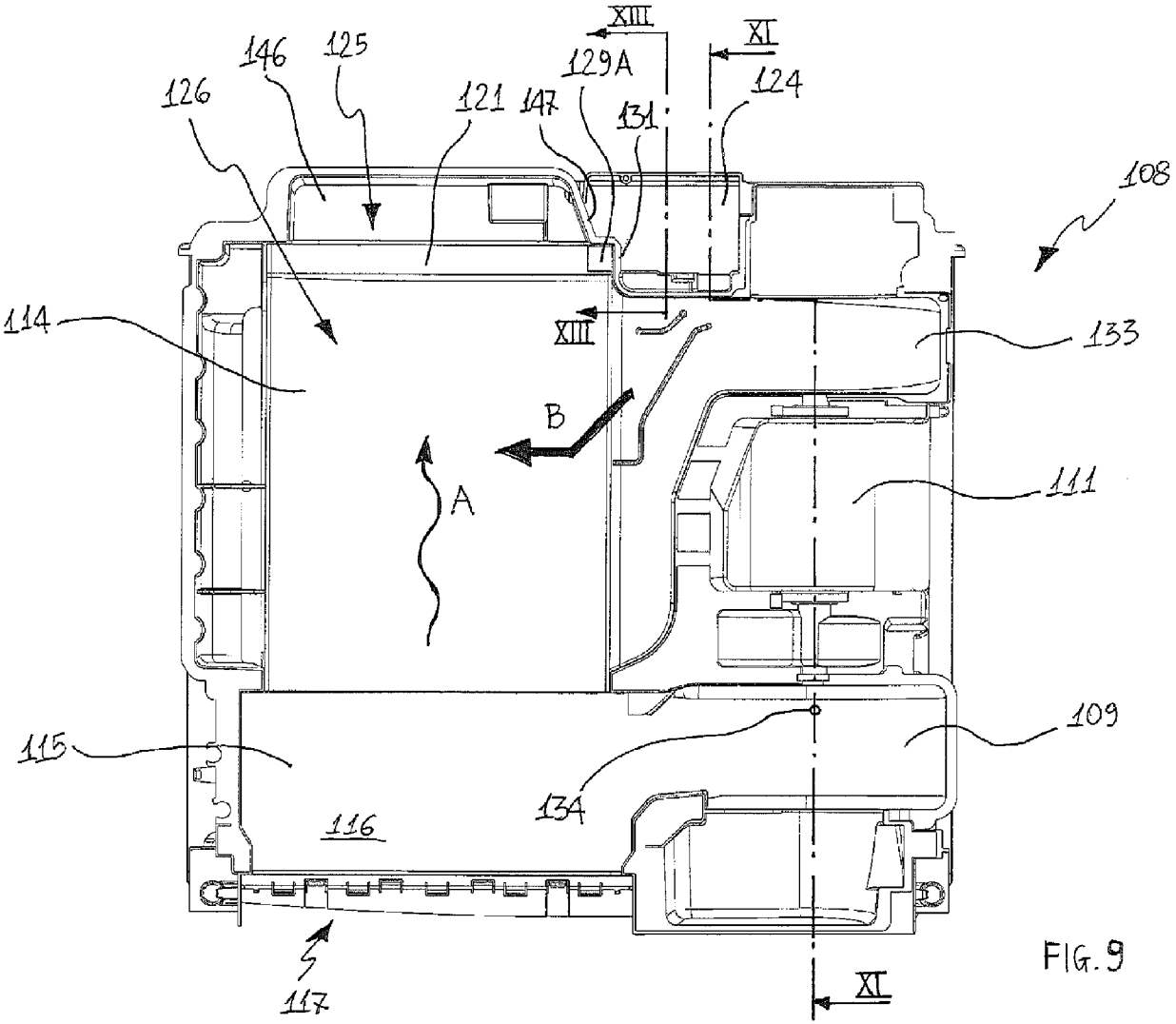
FIG. 9 shows a plane view of a second embodiment of a basement for a laundry dryer according to the invention.
Figure 10:
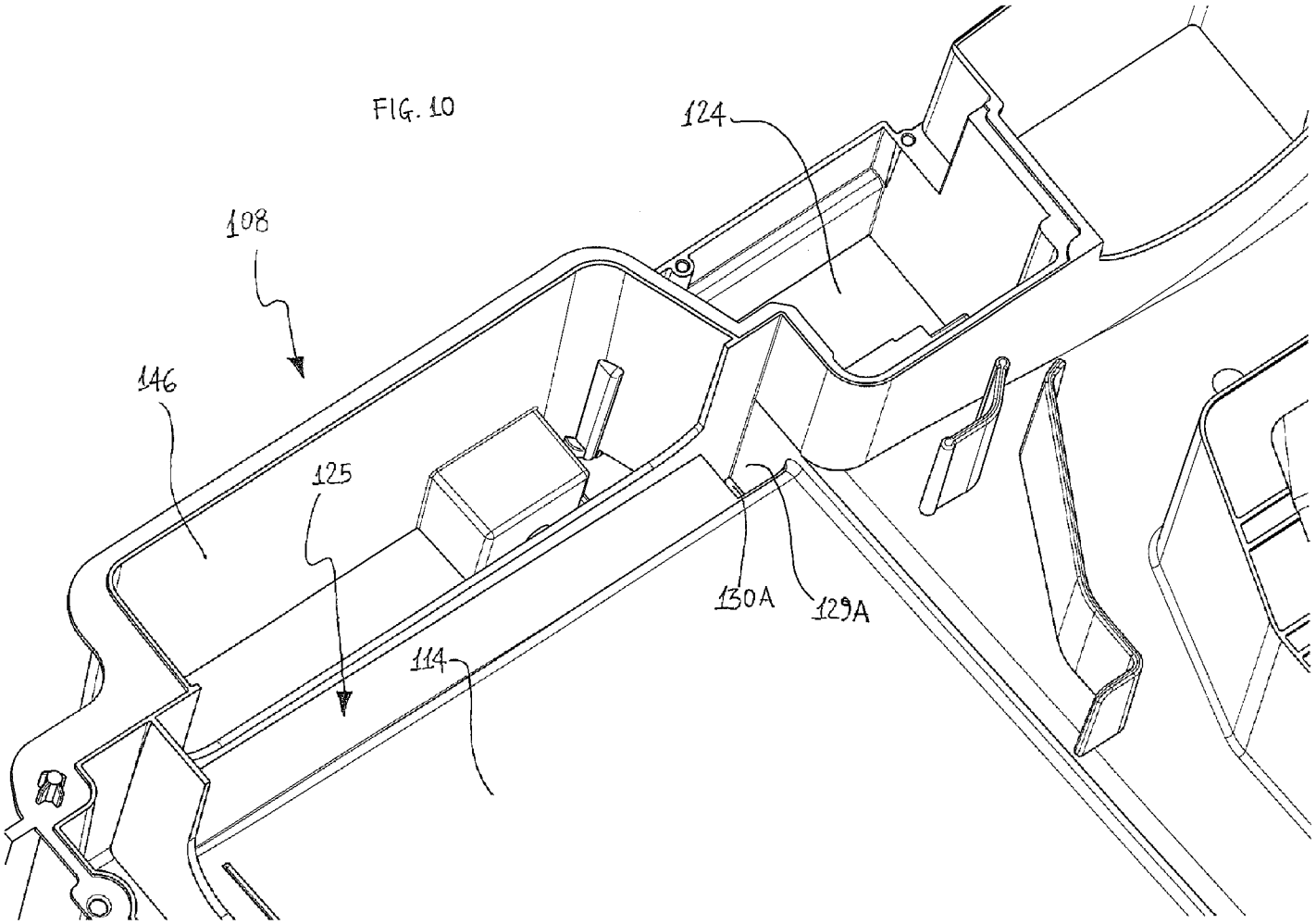
FIG. 10 shows a perspective view of a condensate reservoir of the basement shown in FIG. 9.

With reference to FIGS. 9 and 10, disclosed is a second embodiment of a basement 108 for a condenser type laundry dryer according to the invention. Such basement 108 comprises a first fan seat portion 109 for partly receiving a fan 145 (schematically shown in FIG. 11) that moves drying air, i.e. air circulating within a drying air circuit that fluidly connects a laundry container with air dehumidifying and air heating devices. A second fan seat portion 133 partly receives a further fan for pumping ambient air towards an air-air condensing unit (not shown), laying over a basement supporting surface 114, as indicated by arrow "B" in FIGS. 9. An electric motor seat 111 is arranged between the first and the second fan seats 109, 133 for powering them through a single shaft line.

A condensing unit (not shown) in the form of an air-air heat exchanger receives drying air in a direction schematically indicated by arrow "A" in FIG. 9, while cooling air is supplied along direction "B". In this way moisture contained in drying air is condensed and drops onto the condensing unit basement supporting surface 114. Said surface 114 forms a condensate guide 126 sloping towards the rear cabinet wall 2B thereby directing condensate into a reservoir 124. Similarly to the arrangement described above with reference to FIG. 8 in connection with the first embodiment of the present invention, such reservoir 124 is placed in the rear part of basement 108 in proximity of, but without being covered by, cabinet rear wall 2B, i.e. the wall opposite to cabinet wall 2A provided with a laundry loading opening closed by a hinged door 5. In this way, reservoir 124 may be easily accessible from the outside rear part of machine casing 1 by removing only a cover attached thereon and without the need to disassemble the whole rear side upright cabinet wall 2B. Further advantageously, reservoir 124 may be integrally molded with basement 108. Still similarly to the arrangement described above with reference to FIG. 8, condensate collected within reservoir 124 is then pumped up by a pumping device to an extractable moisture tank in the form of a drawer 6 placed on a front upper portion of the cabinet 1 for periodical emptying operation.

Condensing unit supporting surface 114 forms a part of a condensate draining path 121 extending in parallel with drying air flow and preferably made as an integral part of basement 108. A further part of said path 121 extends transversally to the drying air flow in an edge region 125 of basement 108 and surrounds the supporting surface 114 for receiving condensate poured by the condensate guide 126 to lead it to reservoir 124.

Condensate draining path 121 extends at least partly within the drying air circuit while reservoir 124 is placed outside such circuit, i.e. it is separated from the drying circuit. Therefore, in order to prevent drying air drained together with condensate along path 121 from reaching and entering reservoir 124, a condensate retaining region 129A is provided in the condensate draining path 121 in proximity of reservoir 124, preferably as an integral part of basement 108. As already described with reference to the first embodiment of basement 8, the aim of said retaining region 129A is to create a liquid barrier or trap to air that may accidentally be drained, i.e. dispersed through path 121. This can be achieved, for example, by a siphon-shaped surface 130A that may have an outlet opening which coincides with passage 131 to lead condensate from path 121 to reservoir 124, as shown in FIGS. 9, 10 and 13, or, as an alternative, such siphon-shaped surface 130A may have an outlet opening provided upstream of passage 131, i.e. in proximity thereof.

In a further alternative embodiment the outlet opening can be provided downstream of opening 131.

Figure 13:
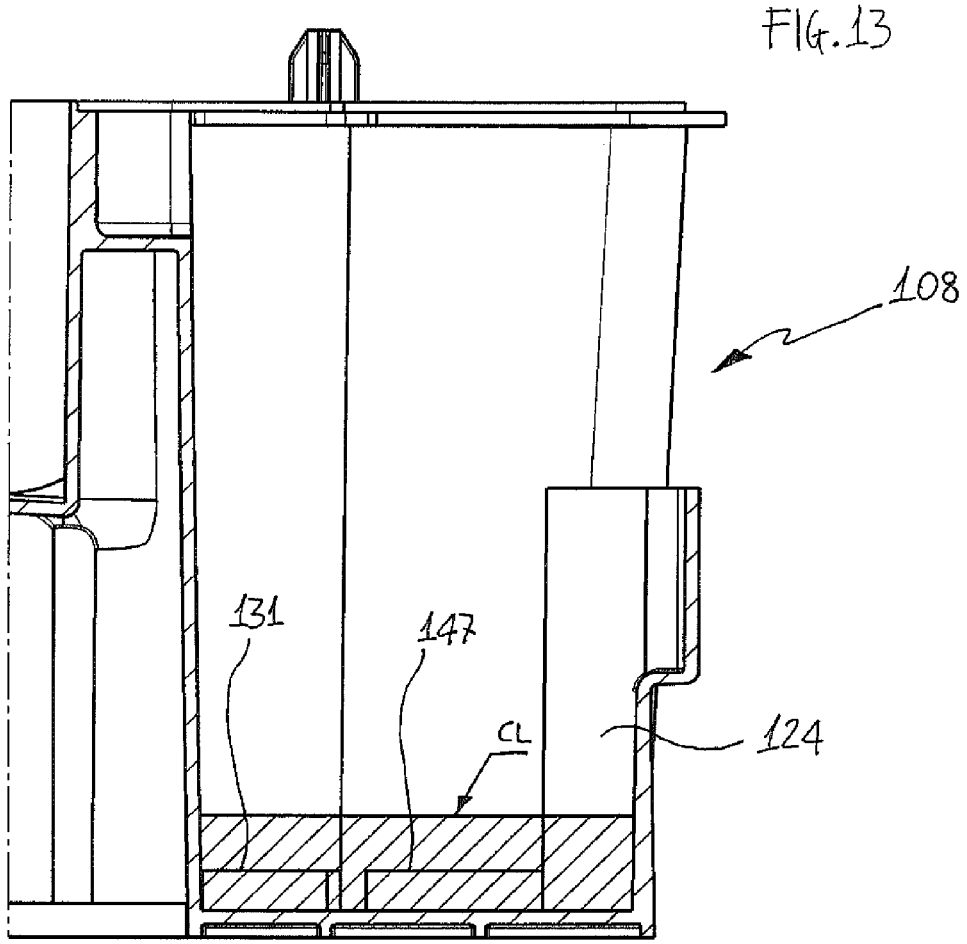
FIG. 13 shows a partial sectional view taken along line XIII-XIII of FIG. 9.

FIG. 13 shows how a condensate level "CL" within reservoir 124, being higher that the upper edge of passage 131, forms a liquid trap for preventing drying air dispersing along path 121 from entering reservoir 124. In the same FIG. 13 and also in FIG. 9, it is also disclosed a further passage 147 which puts in fluid communication reservoir 124 with a conveyor portion 146 provided for receiving drying air flow "A" exiting a condensing unit (not shown) and deviating such air flow from a substantially horizontal plane to a substantially vertical plane so as to direct air into a laundry container. Since conveyor portion 146 may be a region where moisture still remaining within drying air may condense, it is advantageous to fluidly connect this portion 146 with reservoir 124. Similarly to what has been described above with reference to passage 131, condensate level "CL" within reservoir 124 forms a liquid trap for preventing drying air circulating in the conveyor 146 from entering reservoir 124.

Figure 11:
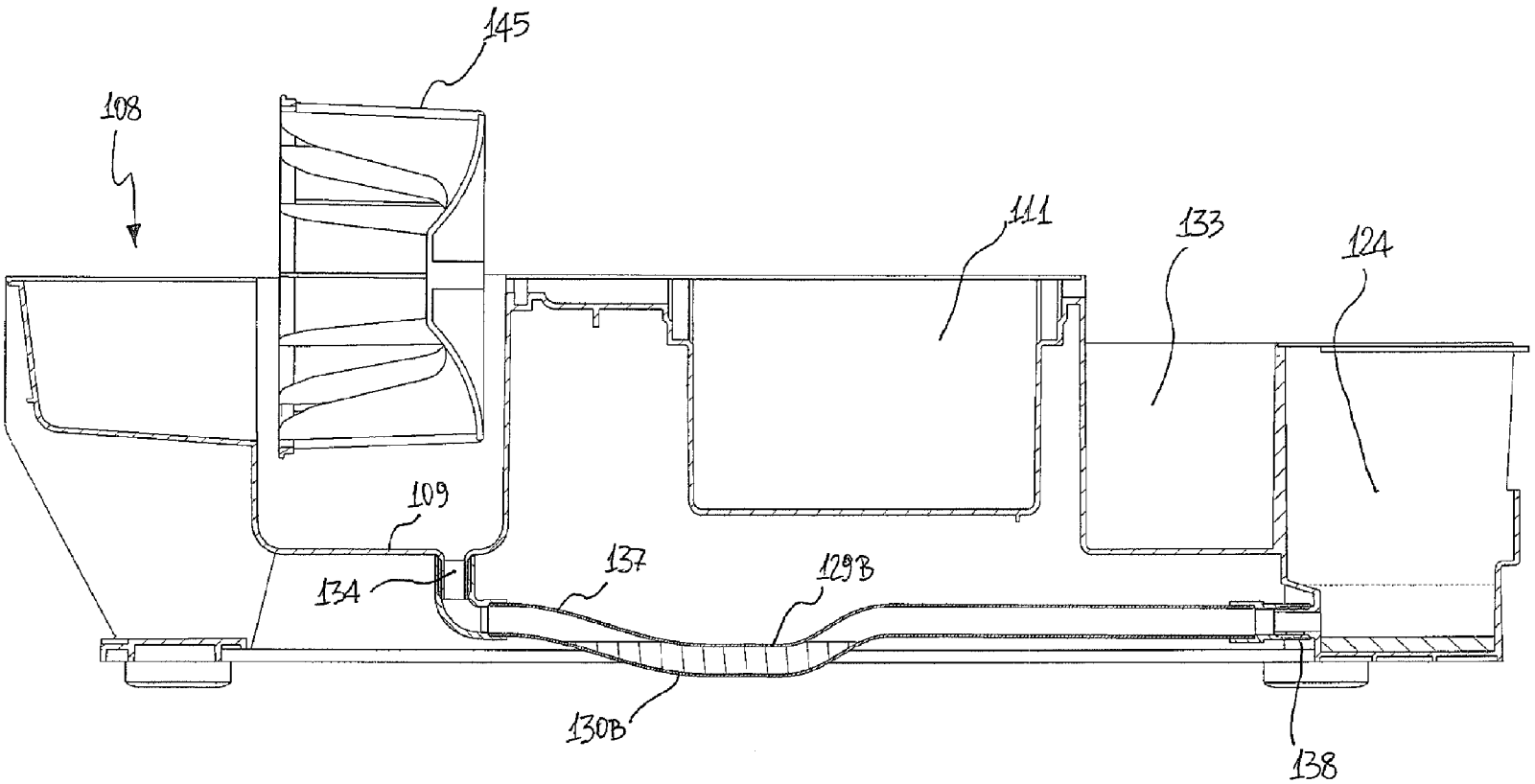
FIG. 11 shows a sectional view taken along line XI-XI of FIG. 9.
Figure 12:
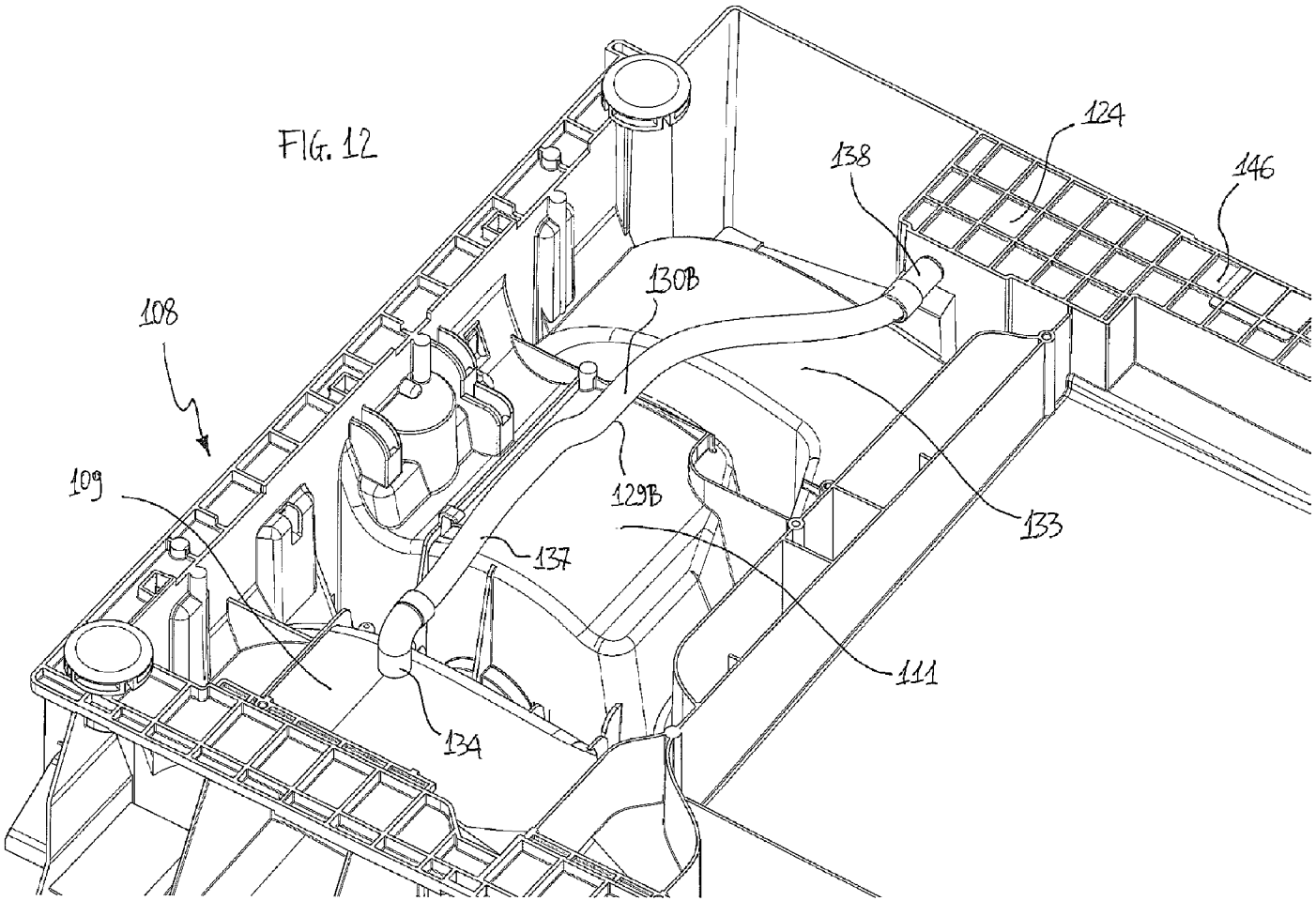
FIG. 12 shows a bottom perspective view of the second embodiment of a basement.

With reference to FIGS. 11 and 12, in correspondence of fan seat 109, basement 108 may be provided with a through bore 134 that is in fluid communication with reservoir 124 by means of a hose 137 that is placed on a opposite side of basement 108 relative to condensing draining path 121 and it is fluidly connected to reservoir 124 through a connector 138. Through bore 134 and the hose 137 connected thereto serves to drain moisture that may condense from drying air within the fan seat 109. Additionally, in order to prevent air drained into hose 137 to reach and entering reservoir 124, a further condensate retaining region 129B may be formed in the hose 137 by simply bending the latter in a substantially U-shaped configuration thereby conferring to said region 129B a preferred siphon-shape surface 130B.

A surface 115 is provided in a basement region 117 upstream of said condensing unit supporting surface 114 considering the drying air flow direction schematically indicated by arrows A in FIG. 9. Surface 115 is placed at the bottom of a chamber 116 of the basement region 117 that receives drying air coming out along a substantially vertical plane from a laundry container laying over the basement 8 and then directs such air towards the condensing unit for removing moisture therefrom by a condensing process along a substantially horizontal plane as indicated by arrow "A" in FIG. 9. Inside the chamber extending over surface 115, the basement region 17 is preferably provided with a fluff filter extending in a transverse direction relative to the drying air flow schematically indicated by arrow A. Periodical cleaning of fluff filter may be performed manually by removing such filter after having accessed said chamber through an opening covered by a hinged door, similarly to what has been described above with reference to the first embodiment of basement 8.

Since surface 115 faces the condensing unit, i.e. a heat exchanger capable of condensing moisture contained in drying air, and considering that chamber extending over surface 115 receives drying air after it has just left the laundry container, i.e. air highly enriched in moisture, surface 115 is arranged to drain moisture that condenses before entering the condensing unit. Therefore, a portion of a condensate draining path 121 may be provided on surface 115 of basement region 117, i.e. in a front portion thereof.

As it can be inferred from the description above, a laundry dryer according to the invention has an efficient and reliable condensed moisture draining circuit interposing one or more physical, i.e. fluid, barrier to accidental passage of drying air from a drying air circuit to a reservoir where condensed water is collected.

According to the invention, drying performance may be improved because drying air does not leak through a condensed moisture draining circuit. In addition, the present invention allows to collect moisture that may incidentally condense onto regions of the drying air circuit where temperature is favorable and to efficiently drain it towards a reservoir. In this way condensate formed on undesired regions of a drying air circuit does not represent a source of possible performance reduction for operational components of a laundry dryer.

Advantageously, fluff incidentally flushed away by condensing moisture from surfaces onto which it may be accumulated is prevented from reaching and entering a reservoir where condensate is collected thereby avoiding damages to a pump provided for pumping condensate from said reservoir to a main water container.

The present invention can be applied to all machine suitable to carry out a drying treatment on laundry, i.e. it can be applied on a heat pump type laundry dryer, a condenser type laundry dryer or a washing-drying machine, that is a machine adapted to both washing and drying laundry.

The invention claimed is:

1. A laundry dryer comprising a casing accommodating therein a drying air circuit and operational devices for carrying out a drying treatment on laundry, said dryer further comprising a basement having a condensate draining path for conveying moisture condensed from drying air towards a reservoir, wherein at least one condensate retaining region is provided along the condensate draining path and/or on the reservoir, said retaining region being configured to cause condensate to collect therein to a level effective to form a liquid trap blocking drying air dispersing along the draining path from entering the reservoir, while allowing condensate to drain into the reservoir.

2. A laundry dryer according to claim 1 wherein said at least one condensate retaining region comprises a siphon-shaped surface.

3. A laundry dryer according to claim 1 wherein the condensate draining path extends at least partly on an edge region of the basement from a front to a rear side thereof.

4. A laundry dryer according to claim 1 wherein the condensate draining path is in fluid communication with one or more supporting surfaces provided on the basement for supporting one of said operational devices.

5. A laundry dryer according to claim 4 wherein said one or more supporting surfaces comprise at least a condensate guide for guiding condensate towards the draining path.

6. A laundry dryer according to claim 5 wherein the condensate draining path extends, at least in part, transversally relative to said condensate guide.

7. A laundry dryer according to claim 1 wherein the condensate draining path, and/or the at least one condensate retaining region and/or the reservoir are integrally molded with the basement.

8. A laundry dryer according to claim 1 wherein the reservoir is arranged in proximity of a first cabinet rear wall, which is opposite to a second cabinet front wall on which a laundry loading opening is formed, so as to be accessible from an outside rear part of machine casing.

9. A laundry dryer according to claim 1 wherein the condensate draining path extends at least partly within a drying air circuit of the dryer, and the reservoir is separated from the circuit.

10. A laundry dryer according to claim 1 wherein said at least one condensate retaining region comprises a filter.

11. A laundry dryer according to claim 1 wherein the operational devices comprises a heat pump system having a refrigerant fluid evaporating unit resting on a supporting surface formed in the basement, and a condensate retaining region is arranged on a surface that extends upstream of said supporting surface.

12. A laundry dryer according to claim 11 wherein said condensate draining path extends from a surface provided in a region of the basement upstream of said refrigerant fluid evaporating unit supporting surface towards the reservoir (24).

13. A laundry dryer according to claim 1 wherein the basement comprises an air pumping device supporting seat having a through bore in fluid communication with the reservoir by means of a hose.

14. A laundry dryer according to claim 13 wherein said hose comprises a condensate retaining region formed by bending the hose in a U-shaped configuration.

15. A laundry dryer according to claim 13 wherein said hose and the condensate draining path are arranged on opposite sides of the basement.

16. A laundry dryer according to claim 2 wherein the condensate draining path extends at least partly on an edge region of the basement from a front to a rear side thereof.

17. A laundry dryer according to claim 3 wherein the condensate draining path is in fluid communication with one or more supporting surfaces provided on the basement for supporting one of said operational devices.

18. A laundry dryer according to claim 3 wherein the condensate draining path extends at least partly within a drying air circuit of the dryer, and the reservoir is separated from the circuit.

19. A laundry dryer according to claim 4 wherein the condensate draining path extends at least partly within a drying air circuit of the dryer, and the reservoir is separated from the circuit.

20. A laundry dryer according to claim 8 wherein the condensate draining path extends at least partly within a drying air circuit of the dryer, and the reservoir is separated from the circuit.

* * * * *